United States Patent [19]

Asselman et al.

[11] 3,994,337

[45] Nov. 30, 1976

[54] COOLING SYSTEM

[75] Inventors: George Albert Apolonia Asselman; Jan Mulder, both of Eindhoven, Netherlands

[73] Assignee: U.S. Philips Corporation, New York, N.Y.

[22] Filed: May 7, 1975

[21] Appl. No.: 575,181

Related U.S. Application Data

[63] Continuation of Ser. No. 386,311, Aug. 7, 1973, abandoned.

[30] Foreign Application Priority Data

Sept. 27, 1972 Netherlands ..... 7213021

[52] U.S. Cl. ..... 165/119; 55/269; 62/317; 123/41.49; 123/41.51; 165/134; 165/151

[51] Int. Cl.[2] ..... F28F 13/06; F28F 19/00

[58] Field of Search ..... 165/119, 134, 151; 55/269, 267; 62/317, 243, 244, 323; 123/41.49, 41.51, 41.48

[56] References Cited

UNITED STATES PATENTS

| | | | |
|---|---|---|---|
| 1,220,888 | 3/1917 | Porter | 180/68 R |
| 1,666,485 | 4/1928 | Bradford | 180/68 R |
| 1,711,702 | 5/1929 | Spreen | 165/119 |
| 2,542,238 | 2/1951 | Dreyfuss | 165/119 X |
| 2,738,652 | 3/1956 | Phillipp | 62/244 X |
| 2,796,141 | 6/1957 | Schreiner | 165/119 X |
| 2,932,177 | 4/1960 | Brennan | 62/244 |
| 3,191,418 | 6/1965 | Modine | 165/151 |
| 3,275,072 | 9/1966 | Suchomel | 165/134 |

FOREIGN PATENTS OR APPLICATIONS

| | | | |
|---|---|---|---|
| 861,085 | 1/1941 | France | 165/148 |

*Primary Examiner*—Albert W. Davis, Jr.
*Assistant Examiner*—Sheldon Richter
*Attorney, Agent, or Firm*—Frank R. Trifari

[57] ABSTRACT

A cooling system for a combustion engine with a radiator wherein a plurality of cooling medium pipes are arranged in one plane, the pipes being connected by strips of gauzes, with air ducts between the strips or in the gauzes having a hydraulic diameter ($d_h$) of less than 2 mm, the length (L) of said ducts being less than 25 mm, and $L/d_h<25$. The radiator is preceded by a dirt collector consisting of a thin zigzag-folded air-transmitting layer with ducts having a hydraulic diameter of less than 2 mm.

4 Claims, 3 Drawing Figures

COOLING SYSTEM

This is a continuation of application Ser. No. 386,311, filed Aug. 7, 1973 now abandoned.

BACKGROUND OF THE INVENTION

This invention relates to a cooling system for use with a combustion engine and comprising a radiator having a number of cooling medium pipes which communicate on the one side with an inlet and on the other side with an outlet for cooling medium. A plurality of metal parts such as strips or gauze are connected to said pipes on which they extend in the transverse direction and with which they are in heat-conductive contact. The said pipes are arranged mainly in one plane. Cooling systems comprising a radiator of the kind set forth are known and have the drawback that they are rather bulky which is inconvenient when building such radiators into cars; also the material costs are substantial due to their large weight.

SUMMARY OF THE INVENTION

The invention has for its object to provide an improved cooling system having a large cooling capacity per unit of front surface area. To this end, the cooling system according to the invention is characterized in that the air ducts between the metal parts have a hydraulic diameter which is smaller than 2 mm. the radiator having a thickness of less than 25 mm and $L/d_h < 25$, $L$ being the thickness of the radiator and $d_{h(R)}$ being the hydraulic diameter of the said air ducts. A dirt collector is arranged on one side in front of the radiator, the dirt collector consisting of a thin zigzag-folded layer with air passage ducts having a hydraulic diameter $d_{h(c)}$ of less than 2 mm.

By providing the radiator according to the invention with such a fine structure that the hydraulic diameter $d_{h(c)}$ of the air ducts is less than 2 mm and their length is less than 25 mm, a substantial increase of the heat transfer capacity is achieved. This means that the front surface area and the overall weight can be much smaller and lower, respectively, than with a conventional radiator.

However, due to the said fine structure, impurities present in the air can no longer pass through the radiator so that they remain on the front surface, thus clogging the radiator or part thereof.

To counteract this phenomenon, a dirt collector is arranged in front of the radiator according to the invention. This dirt collector consists of a thin material layer having a fine structure such that the hydraulic diameter of the air ducts does not exceed 2 mm. This thin layer is zigzag-folded with the result that a number of parallel vees is produced. The impurities present in the air now slide along the flanks of the vees and arrive in the back of the vees where they can be readily removed at a later stage. The air from which the impurities have thus been removed passes through the thin layer without substantial friction loss and subsequently flows through the radiator which now remains clean.

In a further embodiment of the system according to the invention, the dirt collector comprises a number of cooling medium pipes which communicate on the one side with an inlet and on the other side with an outlet for cooling medium of an air-conditioning installation and which are furthermore connected to the said thin layer in a heat-conductive manner. In this embodiment the dirt collector at the same time serves as the condensor of the air-conditioning system which is provided, for example, in a car.

The invention will be described in detail hereinafter with reference to the drawing.

DESCRIPTION OF THE PREFERRED EMBODIMENT

Figure 1:
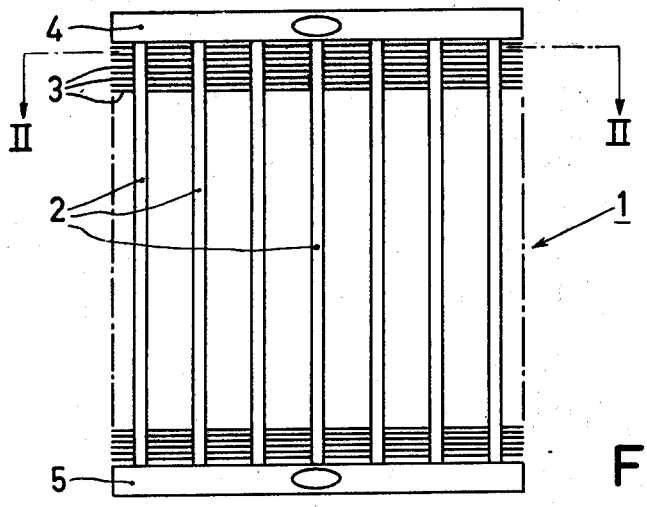
FIGS. 1 and 2 diagrammatically show (not to scale) a plan view and a sectional view, respectively of a cooling system.
Figure 2:
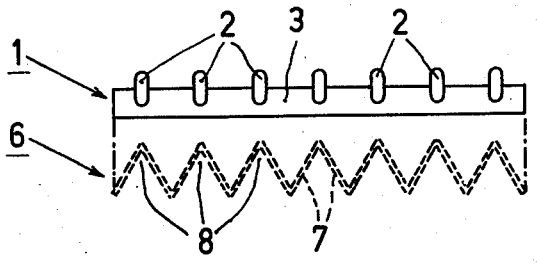

The reference numeral 1 in FIGS. 1 and 2 denotes a radiator. This radiator comprises a number of parallel cooling medium or radiator pipes 2 which are connected in a heat-conductive manner to a very large number of thin metal strips 3. The cooling medium pipes 2 each communicate via one end with a cooling medium inlet 4, manifold and via the other end with a cooling medium outlet manifold 5.

The metal strips 3 are arranged to be so close together that the hydraulic diameter, $d_{h(R)}$, of the gaps or ducts for the air situated therebetween amounts to less than 0.85 mm. The width of the strips 3 is 4 mm. As a result of this very small dimension, the pipes 2 project outside the strips 3 as a result of the dimensional requirements to be imposed thereon. To ensure that the narrow gaps are not quickly contaminated by impurities present in the air, a dirt collector 6 is arranged in front of the radiator. This dirt collector consists of a very thin gauze layer 7 which is zigzag-folded so that a number of parallel vees is produced with the closed parts of the V's adjacent th intake side of the ducts. The meshes of the gauze layer 7 are chosen to be so small that their hydraulic diameter, $d_n$(c) is, less than 2 mm. As a result of this fine structure, impurities present in the air cannot pass the gauze layer 7 and will slide along the flanks of the vees, the dirt collecting at the area 8. It should be removed from time to time from this area, for example, by spraying with a water yet. The impurities are thus prevented from reaching the radiator 1.

The following example will demonstrate that the finer structure of the radiator 1 has major consequences as regards its heat transfer capacity and also as regards its weight. Due to the change of the hydraulic diameter from 4 mm to 2.55 mm, while the thickness L of the radiator remains constant, the heat transfer capacity is increased by a factor 1.3. If the quantity of heat to be transferred remains the same, the required front surface area is thus reduced by a factor 1.3. However, the weight of the radiator has now been increased by a factor 1.15.

However, it was also found that the heat transfer capacity of a radiator can be held constant as long as $L/d_{n(R)}$ remains constant, L being the thickness of the radiator and $d_{H(R)}$ being the hydraulic diameter of the ducts between the metal strips. Consequently, by reducing $d_{h(R)}$ can be reduced by a factor $x^2$. In practice, $x = 3$ can be used. The hydraulic diameter $d_{h(R)}$ will then be 0.85 mm, and the thickness of the radiator, normally being approximately 40 mm, is then reduced to approximately 4 mm. A radiator is thus obtained which combines an increase of the heat transfer capacity by a factor 1.3 with a weight saving by a factor 3.6. Particularly the weight saving is important in view of the material consumption and the associated cost price of the radiator. Due to the higher heat transfer capacity, building into cars can be more readily effected.

Figure 3:
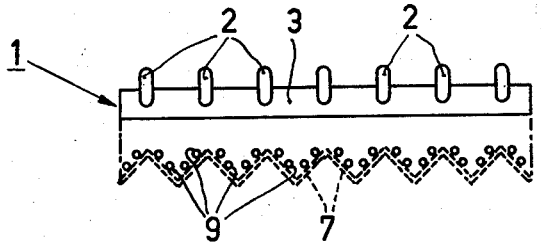
FIG. 3 is a diagrammatic plan view of the same cooling system as shown in the preceding Figures, be it that the dirt collector is now constructed as the condensor for an air-conditioning system.

It will be obvious from the foregoing that the finer structure of the radiator offers major advantages. Contamination is counteracted by the provided zigzag-folded dirt collector. This dirt collector itself can alternatively be constructed as a heat exchanger. As is diagrammatically shown in FIG. 3, cooling medium or condensor pipes 9*a* are then soldered to the gauze layer 7*a*. These cooling medium pipes can form part of the air-conditioning installation such as used in some types of cars. The dirt collector 6*a* then also serves as the condensor in the air-conditioning system.

What is claimed is:

1. In a radiator system for providing cooling for an engine and an air-conditioner, the system including a plurality of radiator pipes for cooling medium, inlet means for distributing said medium from said engine to said pipes, and outlet means for discharging said medium from said pipes to said engine, the improvement in combination therewith comprising (a) a first member in heat-conductive contact with said pipes and defining a plurality of air ducts having generally parallel and adjacent air flow paths through which air can flow from intake ot discharge sides, said ducts each having a hydraulic diameter, $d_{h(R)}$ <2/mm, length, L < 25 mm, in the direction of flow, and ratio $l/d_{h(R)}$ 25, and (b) a dirt collector comprising a thin, zigzag layer fixedly positioned on the intake side and transverse of said ducts, said collector being a porous member defining therein additional air ducts having a hydraulic diameter, $d_{h(C)}$ <2 mm, said system further comprising a plurality of condensor pipes in heat-conductive contact with said dirt collector and operable as a condensor for fluid refrigerant flowing from said air-conditioner.

2. Apparatus according to claim 1 wherein said radiator pipes define a generally flat layer and said first member comprises a plurality of metal strips extending generally parallel to each other and also defining a generally flat layer between two radiator pipes.

3. A cooling system operable with first cooling medium for use in a combustion engine and a second cooling medium for an air-conditioner, comprising (a) a radiator having a plurality of first pipes positioned generally in a plane, inlet and outlet means for flowing said first cooling medium through said pipes, a plurality of metal part such as strips or gauze, with air ducts, defined between said parts, which part are connected to said pipes in heat-conductive contact, characterized in that said air ducts between said metal parts have a hydraulic diameter $d_{h(R)}$ which is smaller than 2 mm, and have thickness L of less than 25 mm, and $L/d_{h(R)}$ 25, $L$ representing the thickness in the direction of air flow from front intake side to dischrge side, (b) a dirt collector formed as a thin zigzag-folded layer arranged on said front side of the radiator, and comprising passage ducts therethrough for the air, having a hydraulic diameter, $d_{h(C)}$ of less than 2 mm, and (c) a plurality of second pipes, inlet and outlet means for flowing said second cooling medium through said second pipes which are furthermore connected to the folded layer in heat-conductive contact.

4. In a radiator system for cooling a fluid, the system including a plurality of radiator pipes spaced apart and defining a generally flat layer, means for flowing said fluid into and out of said pipes, the improvement in combination therewith comprising (a) a plurality of metal strips spaced apart and extending between two adjacent pipes with a duct defined between two adjacent strips, the duct having a flow direction of length, L < 25 mm transverse of and through said layer, and havinng a hydraulic diameter $d_{h(R)}$ < 2 mm, and $L/d_{h(R)}$ <25, the ducts having intake and exhaust ends, and (b) a dirt collector formed as a zigzag folded lyer providing inlet channels which are V-shaped in cross-section with air flowing toward the closed parts of the Vs which part are adjacent the intake side of said ducts, said folded layer being porous with air passages defined therethrough which have a hydraulic diameter $d_{h(C)}$ < 2 mm, said radiator system being operable with an air-conditioner, and further comprising a plurality of condensor pipes in heat conductive relationship with said dirt collector and operable as a condensor for fluid refrigerant flowing from said air-conditioner, which is cooled by air flowing through said dirt collector.

* * * * *

UNITED STATES PATENT AND TRADEMARK OFFICE

CERTIFICATE OF CORRECTION

PATENT NO. : 3,994,337

DATED : November 30, 1976

INVENTOR(S) : GEORGE ALBERT APOLONIA ASSELMAN and JAN MULDER

It is certified that error appears in the above-identified patent and that said Letters Patent are hereby corrected as shown below:

Col. 2, line 24, after "inlet" should be --manifold--; after "4," delete "manifold"

line 63, after "$D_{h(R)}$", insert --by a factor X, L--

Col. 4, line 31, "havinng" should be --having-- line 33, "lyer" should be --layer--

Signed and Sealed this

First Day of March 1977

[SEAL]

*Attest:*

RUTH C. MASON
*Attesting Officer*

C. MARSHALL DANN
*Commissioner of Patents and Trademarks*